US010828798B2

(12) United States Patent
Fransson

(10) Patent No.: US 10,828,798 B2
(45) Date of Patent: Nov. 10, 2020

(54) METHOD AND DEVICE FOR INSERTING A TONGUE

(71) Applicant: Välinge Innovation AB, Viken (SE)

(72) Inventor: Jonas Fransson, Allerum (SE)

(73) Assignee: VALINGE INNOVATION AB, Viken (SE)

( * ) Notice: Subject to any disclaimer, the term of this patent is extended or adjusted under 35 U.S.C. 154(b) by 356 days.

(21) Appl. No.: 15/635,532

(22) Filed: Jun. 28, 2017

(65) Prior Publication Data

US 2018/0001510 A1 Jan. 4, 2018

(30) Foreign Application Priority Data

Jun. 29, 2016 (SE) ..... 1650941

(51) Int. Cl.

*B27G 13/00* (2006.01)
*B27F 1/12* (2006.01)
*B27G 13/08* (2006.01)

(52) U.S. Cl.

CPC ..... *B27F 1/12* (2013.01); *B27G 13/005* (2013.01); *B27G 13/08* (2013.01)

(58) Field of Classification Search

CPC ..... B27F 1/12; B27G 13/08; B27G 13/005; Y10T 29/49121; Y10T 29/49139; Y10T 29/4914

See application file for complete search history.

(56) References Cited

U.S. PATENT DOCUMENTS 1,194,636 A 8/1916 Joy
1,902,716 A 3/1933 Newton
3,114,477 A 12/1963 Dixon
3,147,522 A 9/1964 Schumm
3,381,730 A 5/1968 Omholt
3,572,224 A 3/1971 Perry
3,579,941 A 5/1971 Tibbals
3,584,761 A 6/1971 Flanigan et al.
3,720,027 A 3/1973 Christensen (Continued)

FOREIGN PATENT DOCUMENTS

DE 25 05 489 A1 8/1976
DE 197 52 286 A1 5/1999

(Continued)

OTHER PUBLICATIONS

International Search Report and Written Opinion issued in PCT/SE2017/050718, dated Sep. 15, 2017, 11 pages, ISA/SE, Patent-och registreringsverket, Stockholm, SE.

(Continued)

*Primary Examiner* — Rick K Chang

(74) *Attorney, Agent, or Firm* — Buchanan Ingersoll & Rooney P.C.

(57) ABSTRACT

A method and device for inserting a tongue in an insertion groove in a panel. The method includes displacing a first tongue to an end position of a tongue queue, which comprises tongues under compression, in a tongue queue device, compressing the first tongue, displacing the tongues in the tongue queue by compression forces from the tongues under compression, displacing a second tongue, which is at a front position of the tongue queue, to an inserting device, displacing the second tongue into an insertion groove in a panel by said inserting device.

7 Claims, 10 Drawing Sheets

(56) References Cited

U.S. PATENT DOCUMENTS 3,760,485 A 9/1973 Smith
3,760,547 A 9/1973 Brenneman
3,778,954 A 12/1973 Meserole
3,919,820 A 11/1975 Green
3,930,808 A 1/1976 Miller et al.
4,648,165 A 3/1987 Whitehorne
5,105,980 A 4/1992 Hofmann
5,174,022 A * 12/1992 Phillips ..... H01R 43/055 29/753
5,582,611 A 12/1996 Tsuruta et al.
5,810,239 A 9/1998 Stich
5,996,876 A 12/1999 Dickhoff et al.
6,098,442 A 8/2000 Walldorf et al.
6,273,315 B1 8/2001 McGuinness et al.
6,314,701 B1 11/2001 Meyehson
6,363,677 B1 4/2002 Chen et al.
6,385,936 B1 5/2002 Schneider
6,418,683 B1 7/2002 Martensson et al.
6,446,413 B1 9/2002 Gruber
6,490,836 B1 12/2002 Moriau et al.
6,505,452 B1 1/2003 Hannig
6,647,690 B1 11/2003 Martensson
6,651,400 B1 11/2003 Murphy
6,655,573 B1 12/2003 Chang
6,763,643 B1 7/2004 Martensson
6,766,622 B1 7/2004 Thiers
6,769,835 B2 8/2004 Stridsman
6,804,926 B1 10/2004 Eisermann
6,807,719 B2 * 10/2004 Herr ..... H01R 43/20 29/33 K
6,854,235 B2 2/2005 Martensson
6,880,307 B2 4/2005 Schwitte et al.
7,040,068 B2 5/2006 Moriau et al.
7,051,486 B2 5/2006 Pervan
7,188,456 B2 3/2007 Knauseder
7,451,578 B2 11/2008 Hannig
7,454,875 B2 11/2008 Pervan et al.
7,568,322 B2 8/2009 Pervan
7,584,583 B2 9/2009 Bergelin et al.
7,614,197 B2 11/2009 Nelson
7,617,651 B2 11/2009 Grafenauer
7,621,092 B2 11/2009 Groeke et al.
7,634,884 B2 12/2009 Pervan
7,637,068 B2 12/2009 Pervan
7,677,005 B2 3/2010 Pervan
7,721,503 B2 5/2010 Pervan et al.
7,757,452 B2 7/2010 Pervan
7,802,411 B2 9/2010 Pervan
7,841,144 B2 11/2010 Pervan et al.
7,841,145 B2 11/2010 Pervan et al.
7,841,150 B2 11/2010 Pervan
7,856,789 B2 12/2010 Eisermann
7,861,482 B2 1/2011 Pervan et al.
7,866,110 B2 1/2011 Pervan
7,908,815 B2 3/2011 Pervan et al.
7,908,816 B2 3/2011 Grafenauer
7,930,862 B2 4/2011 Bergelin et al.
7,980,041 B2 7/2011 Pervan
8,033,074 B2 10/2011 Pervan
8,042,311 B2 10/2011 Pervan
8,061,104 B2 11/2011 Pervan
8,079,196 B2 12/2011 Pervan
8,091,238 B2 1/2012 Hannig
8,112,967 B2 2/2012 Pervan et al.
8,171,692 B2 5/2012 Pervan
8,181,416 B2 5/2012 Pervan et al.
8,234,830 B2 8/2012 Pervan et al.
8,256,104 B2 9/2012 Fulbright
8,341,914 B2 1/2013 Pervan et al.
8,341,915 B2 1/2013 Pervan et al.
8,353,140 B2 1/2013 Pervan et al.
8,359,805 B2 1/2013 Pervan et al.
8,381,476 B2 2/2013 Hannig
8,381,477 B2 2/2013 Pervan et al.
8,387,327 B2 3/2013 Pervan
8,448,402 B2 5/2013 Pervan et al.
8,499,521 B2 8/2013 Pervan et al.
8,505,257 B2 8/2013 Boo et al.
8,528,289 B2 9/2013 Pervan et al.
8,544,230 B2 10/2013 Pervan
8,544,234 B2 10/2013 Pervan et al.
8,572,922 B2 11/2013 Pervan
8,596,013 B2 12/2013 Boo
8,627,862 B2 1/2014 Pervan et al.
8,640,424 B2 2/2014 Pervan et al.
8,650,738 B2 2/2014 Schulte
8,650,826 B2 2/2014 Pervan et al.
8,677,714 B2 3/2014 Pervan
8,689,512 B2 4/2014 Pervan
8,707,650 B2 4/2014 Pervan
8,713,886 B2 5/2014 Boo et al.
8,733,065 B2 5/2014 Pervan
8,733,410 B2 5/2014 Pervan
8,763,341 B2 7/2014 Pervan
8,769,905 B2 7/2014 Pervan
8,776,473 B2 7/2014 Pervan et al.
8,844,236 B2 9/2014 Pervan et al.
8,857,126 B2 10/2014 Pervan et al.
8,869,485 B2 10/2014 Pervan
8,898,988 B2 12/2014 Pervan
8,925,274 B2 1/2015 Pervan et al.
8,959,866 B2 2/2015 Pervan
8,973,331 B2 3/2015 Boo
9,027,306 B2 5/2015 Pervan
9,051,738 B2 6/2015 Pervan et al.
9,068,360 B2 6/2015 Pervan
9,091,077 B2 7/2015 Boo
9,120,141 B2 9/2015 Clew et al.
9,194,134 B2 11/2015 Nygren et al.
9,212,492 B2 12/2015 Pervan et al.
9,216,541 B2 12/2015 Boo et al.
9,238,917 B2 1/2016 Pervan et al.
9,284,737 B2 3/2016 Pervan et al.
9,309,679 B2 4/2016 Pervan et al.
9,316,002 B2 4/2016 Boo
9,340,974 B2 5/2016 Pervan et al.
9,347,469 B2 5/2016 Pervan
9,359,774 B2 6/2016 Pervan
9,366,036 B2 6/2016 Pervan
9,376,821 B2 6/2016 Pervan et al.
9,382,716 B2 7/2016 Pervan et al.
9,388,584 B2 7/2016 Pervan et al.
9,428,919 B2 8/2016 Pervan et al.
9,453,347 B2 9/2016 Pervan et al.
9,458,634 B2 10/2016 Derelov
9,482,012 B2 11/2016 Nygren et al.
9,540,826 B2 1/2017 Pervan et al.
9,555,529 B2 1/2017 Ronconi
9,663,940 B2 5/2017 Boo
9,725,912 B2 8/2017 Pervan
9,771,723 B2 9/2017 Pervan
9,777,487 B2 10/2017 Pervan et al.
9,803,374 B2 10/2017 Pervan
9,803,375 B2 10/2017 Pervan
9,856,656 B2 1/2018 Pervan
9,874,027 B2 1/2018 Pervan
9,945,130 B2 4/2018 Nygren et al.
9,951,526 B2 4/2018 Boo et al.
10,006,210 B2 6/2018 Pervan et al.
10,017,948 B2 7/2018 Boo
10,113,319 B2 10/2018 Pervan
10,125,488 B2 11/2018 Boo
10,138,636 B2 11/2018 Pervan
10,161,139 B2 12/2018 Pervan
10,180,005 B2 1/2019 Pervan et al.
10,214,915 B2 2/2019 Pervan et al.
10,214,917 B2 2/2019 Pervan et al.
10,240,348 B2 3/2019 Pervan et al.
10,240,349 B2 3/2019 Pervan et al.
10,246,883 B2 4/2019 Derelöv
10,352,049 B2 7/2019 Boo
10,358,830 B2 7/2019 Pervan
10,378,217 B2 8/2019 Pervan
10,458,125 B2 10/2019 Pervan

(56) References Cited

U.S. PATENT DOCUMENTS 10,526,792 B2 1/2020 Pervan et al.
10,538,922 B2 1/2020 Pervan
10,570,625 B2 2/2020 Pervan
10,640,989 B2 5/2020 Pervan
10,655,339 B2 5/2020 Pervan
10,669,723 B2 6/2020 Pervan et al.
2002/0031646 A1 3/2002 Chen et al.
2002/0170259 A1 11/2002 Ferris
2002/0178674 A1 12/2002 Pervan
2003/0009971 A1 1/2003 Palmberg
2003/0024199 A1 2/2003 Pervan et al.
2003/0037504 A1 2/2003 Schwitte et al.
2003/0180091 A1 9/2003 Stridsman
2003/0188504 A1 10/2003 Ralf
2003/0196405 A1 10/2003 Pervan
2004/0016196 A1 1/2004 Pervan
2004/0031227 A1 2/2004 Knauseder
2004/0060255 A1 4/2004 Knauseder
2004/0068954 A1 4/2004 Martensson
2004/0123548 A1 7/2004 Gimpel et al.
2004/0128934 A1 7/2004 Hecht
2004/0200175 A1 10/2004 Weber
2004/0211143 A1 10/2004 Hannig
2004/0244325 A1 12/2004 Nelson
2004/0261348 A1 12/2004 Vulin
2005/0160694 A1 7/2005 Pervan
2005/0205161 A1 9/2005 Lewark
2005/0210810 A1 9/2005 Pervan
2006/0070333 A1 4/2006 Pervan
2006/0101769 A1 5/2006 Pervan
2006/0162814 A1 7/2006 Symossek et al.
2006/0236642 A1 10/2006 Pervan
2006/0260254 A1 11/2006 Pervan et al.
2007/0006543 A1 1/2007 Engström
2007/0011981 A1 1/2007 Eiserman
2007/0028547 A1 2/2007 Grafenauer
2007/0151189 A1 7/2007 Yang et al.
2007/0175156 A1 8/2007 Pervan et al.
2007/0193178 A1 8/2007 Groeke et al.
2008/0000186 A1 1/2008 Pervan et al.
2008/0000187 A1 1/2008 Pervan et al.
2008/0010931 A1 1/2008 Pervan et al.
2008/0010937 A1 1/2008 Pervan et al.
2008/0028707 A1 2/2008 Pervan
2008/0034708 A1 2/2008 Pervan
2008/0041008 A1 2/2008 Pervan
2008/0066415 A1 3/2008 Pervan
2008/0104921 A1 5/2008 Pervan et al.
2008/0110125 A1 5/2008 Pervan
2008/0134607 A1 6/2008 Pervan
2008/0134613 A1 6/2008 Pervan
2008/0134614 A1 6/2008 Pervan
2008/0155930 A1 7/2008 Pervan et al.
2008/0216434 A1 9/2008 Pervan
2008/0216920 A1 9/2008 Pervan
2008/0295432 A1 12/2008 Pervan et al.
2009/0133353 A1 5/2009 Pervan et al.
2009/0193748 A1 8/2009 Boo et al.
2010/0043333 A1 2/2010 Hannig et al.
2010/0218360 A1 9/2010 Mangone, Jr.
2010/0293879 A1 11/2010 Pervan et al.
2010/0300031 A1 12/2010 Pervan et al.
2010/0313714 A1 12/2010 Smith
2010/0319290 A1 12/2010 Pervan
2010/0319291 A1 12/2010 Pervan et al.
2011/0030303 A1 2/2011 Pervan et al.
2011/0041996 A1 2/2011 Pervan
2011/0088344 A1 4/2011 Pervan et al.
2011/0088345 A1 4/2011 Pervan
2011/0088346 A1 4/2011 Hannig
2011/0094083 A1 4/2011 Schulte
2011/0154763 A1 6/2011 Bergelin et al.
2011/0167750 A1 7/2011 Pervan
2011/0167751 A1 7/2011 Engström
2011/0225922 A1 9/2011 Pervan et al.
2011/0252733 A1 10/2011 Pervan
2011/0283650 A1 11/2011 Pervan et al.
2012/0017533 A1 1/2012 Pervan et al.
2012/0031029 A1 2/2012 Pervan et al.
2012/0036804 A1 2/2012 Pervan
2012/0073235 A1 3/2012 Hannig
2012/0151865 A1 6/2012 Pervan et al.
2012/0174515 A1 7/2012 Pervan
2012/0174520 A1 7/2012 Pervan
2012/0279161 A1 11/2012 Håkansson et al.
2013/0008117 A1 1/2013 Pervan
2013/0014463 A1 1/2013 Pervan
2013/0019555 A1 1/2013 Pervan
2013/0042562 A1 2/2013 Pervan
2013/0042563 A1 2/2013 Pervan
2013/0042564 A1 2/2013 Pervan et al.
2013/0042565 A1 2/2013 Pervan
2013/0047536 A1 2/2013 Pervan
2013/0081349 A1 4/2013 Pervan et al.
2013/0111845 A1 5/2013 Pervan
2013/0145708 A1 6/2013 Pervan
2013/0160391 A1 6/2013 Pervan et al.
2013/0232905 A2 9/2013 Pervan
2013/0239508 A1 9/2013 Pervan et al.
2013/0263454 A1 10/2013 Boo et al.
2013/0263547 A1 10/2013 Boo
2013/0318906 A1 12/2013 Pervan et al.
2014/0007539 A1 1/2014 Pervan et al.
2014/0020324 A1 1/2014 Pervan
2014/0033634 A1 2/2014 Pervan
2014/0042203 A1 2/2014 Abe
2014/0053497 A1 2/2014 Pervan et al.
2014/0059966 A1 3/2014 Boo
2014/0069043 A1 3/2014 Pervan
2014/0090335 A1 4/2014 Pervan et al.
2014/0109501 A1 4/2014 Pervan
2014/0109506 A1 4/2014 Pervan et al.
2014/0123586 A1 5/2014 Pervan et al.
2014/0138422 A1 5/2014 Ronconi
2014/0150369 A1 6/2014 Hannig
2014/0190112 A1 7/2014 Pervan
2014/0208677 A1 7/2014 Pervan et al.
2014/0223852 A1 8/2014 Pervan
2014/0237931 A1 8/2014 Pervan
2014/0250813 A1 9/2014 Nygren et al.
2014/0260060 A1 9/2014 Pervan et al.
2014/0305065 A1 10/2014 Pervan
2014/0338177 A1 11/2014 Vermeulen et al.
2014/0366476 A1 12/2014 Pervan
2014/0373478 A2 12/2014 Pervan et al.
2014/0373480 A1 12/2014 Pervan et al.
2015/0000221 A1 1/2015 Boo
2015/0013260 A1 1/2015 Pervan
2015/0059281 A1 3/2015 Pervan
2015/0089896 A2 4/2015 Pervan et al.
2015/0121796 A1 5/2015 Pervan
2015/0152644 A1 6/2015 Boo
2015/0167318 A1 6/2015 Pervan
2015/0211239 A1 7/2015 Pervan
2015/0233125 A1 8/2015 Pervan et al.
2015/0267419 A1 9/2015 Pervan
2015/0300029 A1 10/2015 Pervan
2015/0330088 A1 11/2015 Derelov
2015/0337537 A1 11/2015 Boo
2016/0032596 A1 2/2016 Nygren et al.
2016/0060879 A1 3/2016 Pervan
2016/0069088 A1 3/2016 Boo et al.
2016/0076260 A1 3/2016 Pervan et al.
2016/0090744 A1 3/2016 Pervan et al.
2016/0129573 A1 5/2016 Anstett et al.
2016/0153200 A1 6/2016 Pervan
2016/0168866 A1 6/2016 Pervan et al.
2016/0186426 A1 6/2016 Boo
2016/0194884 A1 7/2016 Pervan et al.
2016/0201336 A1 7/2016 Pervan
2016/0251859 A1 9/2016 Pervan et al.
2016/0251860 A1 9/2016 Pervan
2016/0281368 A1 9/2016 Pervan et al.
2016/0281370 A1 9/2016 Pervan et al.

(56) References Cited

U.S. PATENT DOCUMENTS

| | | | |
|---|---|---|---|
| 2016/0326751 | A1 | 11/2016 | Pervan |
| 2016/0340913 | A1 | 11/2016 | Derelöov |
| 2017/0037641 | A1 | 2/2017 | Nygren et al. |
| 2017/0081860 | A1 | 3/2017 | Boo |
| 2017/0254096 | A1 | 9/2017 | Pervan |
| 2017/0321433 | A1 | 11/2017 | Pervan et al. |
| 2017/0362834 | A1 | 12/2017 | Pervan et al. |
| 2018/0001509 | A1 | 1/2018 | Myllykangas et al. |
| 2018/0001573 | A1 | 1/2018 | Blomgren et al. |
| 2018/0002933 | A1 | 1/2018 | Pervan |
| 2018/0030737 | A1 | 2/2018 | Pervan |
| 2018/0030738 | A1 | 2/2018 | Pervan |
| 2018/0119431 | A1 | 5/2018 | Pervan et al. |
| 2018/0178406 | A1 | 6/2018 | Fransson et al. |
| 2019/0024387 | A1 | 1/2019 | Pervan et al. |
| 2019/0048592 | A1 | 2/2019 | Boo |
| 2019/0048596 | A1 | 2/2019 | Pervan |
| 2019/0063076 | A1 | 2/2019 | Boo et al. |
| 2019/0093370 | A1 | 3/2019 | Pervan et al. |
| 2019/0093371 | A1 | 3/2019 | Pervan |
| 2019/0119928 | A1 | 4/2019 | Pervan et al. |
| 2019/0127989 | A1 | 5/2019 | Kell |
| 2019/0127990 | A1 | 5/2019 | Pervan et al. |
| 2019/0169859 | A1 | 6/2019 | Pervan et al. |
| 2019/0232473 | A1 | 8/2019 | Fransson et al. |
| 2019/0271165 | A1 | 9/2019 | Boo |
| 2019/0376298 | A1 | 12/2019 | Pervan et al. |
| 2019/0394314 | A1 | 12/2019 | Pervan et al. |
| 2020/0087927 | A1 | 3/2020 | Pervan |
| 2020/0102756 | A1 | 4/2020 | Pervan |
| 2020/0109569 | A1 | 4/2020 | Pervan |
| 2020/0149289 | A1 | 5/2020 | Pervan |
| 2020/0173175 | A1 | 6/2020 | Pervan |

FOREIGN PATENT DOCUMENTS

| | | | |
|---|---|---|---|
| DE | 202 05 774 | U1 | 8/2002 |
| DE | 203 20 799 | U1 | 4/2005 |
| DE | 10 2004 055 951 | A1 | 7/2005 |
| DE | 10 2006 057 491 | A1 | 6/2008 |
| EP | 0 974 713 | A1 | 1/2000 |
| EP | 1 420 125 | A2 | 5/2004 |
| EP | 1 650 375 | A1 | 4/2006 |
| EP | 1 674 223 | A1 | 6/2006 |
| EP | 1 650 375 | A8 | 9/2006 |
| EP | 1 674 223 | B1 | 7/2008 |
| EP | 2 395 179 | A2 | 12/2011 |
| EP | 2 689 904 | A1 | 1/2014 |
| EP | 2 732 923 | A2 | 5/2014 |
| EP | 2 774 735 | A1 | 9/2014 |
| EP | 2 732 923 | B1 | 1/2018 |
| GB | 240629 | | 10/1925 |
| GB | 376352 | | 7/1932 |
| GB | 1171337 | | 11/1969 |
| SE | 529 076 | C2 | 4/2007 |
| WO | WO 94/26999 | A1 | 11/1994 |
| WO | WO 96/27721 | A1 | 9/1996 |
| WO | WO 97/47834 | A1 | 12/1997 |
| WO | WO 00/20705 | A1 | 4/2000 |
| WO | WO 00/43281 | A2 | 7/2000 |
| WO | WO 00/47841 | A1 | 8/2000 |
| WO | WO 00/55067 | A1 | 9/2000 |
| WO | WO 01/02669 | A1 | 1/2001 |
| WO | WO 01/02670 | A1 | 1/2001 |
| WO | WO 01/02671 | A1 | 1/2001 |
| WO | WO 01/51732 | A1 | 7/2001 |
| WO | WO 01/75247 | A1 | 10/2001 |
| WO | WO 01/98604 | A1 | 12/2001 |
| WO | WO 03/016654 | A1 | 2/2003 |
| WO | WO 03/044303 | A1 | 5/2003 |
| WO | WO 03/083234 | A1 | 10/2003 |
| WO | WO 03/087497 | A1 | 10/2003 |
| WO | WO 2004/016877 | A1 | 2/2004 |
| WO | WO 2004/020764 | A1 | 3/2004 |
| WO | WO 2004/085765 | A1 | 10/2004 |
| WO | WO 2005/054599 | A1 | 6/2005 |
| WO | WO 2006/043893 | A1 | 4/2006 |
| WO | WO 2006/104436 | A1 | 10/2006 |
| WO | WO 2007/015669 | A2 | 2/2007 |
| WO | WO 2007/015669 | A3 | 2/2007 |
| WO | WO 2007/079845 | A1 | 7/2007 |
| WO | WO 2007/109787 | A2 | 9/2007 |
| WO | WO 2008/068245 | A1 | 6/2008 |
| WO | WO 2009/116926 | A1 | 9/2009 |
| WO | WO 2009/124517 | A1 | 10/2009 |
| WO | WO 2010/001262 | A2 | 1/2010 |
| WO | WO 2010/087752 | A1 | 8/2010 |
| WO | WO 2009/124517 | A1 | 9/2012 |
| WO | WO 2012/154113 | A1 | 11/2012 |
| WO | WO 2013/025164 | A1 | 2/2013 |
| WO | WO 2013/025165 | A1 | 2/2013 |
| WO | WO 2013/037904 | A2 | 3/2013 |
| WO | WO 2015/038059 | A1 | 3/2015 |
| WO | WO 2017/135874 | A1 | 8/2017 |

OTHER PUBLICATIONS

International Search Report and Written Opinion issued in PCT/SE2017/050716, dated Sep. 15, 2017, 10 pages, ISA/SE, Patent-och registreringsverket, Stockholm, SE.

International Search Report and Written Opinion issued in PCT/SE2017/050717, dated Sep. 19, 2017, 13 pages, ISA/SE, Patent-och registreringsverket, Stockholm, SE.

International Search Report and Written Opinion issued in PCT/SE2017/051305, dated Mar. 5, 2018, 12 pages, ISA/SE, Patent-och registreringsverket, Stockholm, SE.

Extended European Search Report dated Jan. 2, 2020 in EP 17820655.3, European Patent Office, Munich, DE, 14 pages.

Extended European Search Report dated Dec. 9, 2019 in EP 17820656.1, European Patent Office, Munich, DE, 10 pages.

Extended European Search Report dated Jan. 30, 2020 in EP 17820652.0, European Patent Office, Munich, DE, 10 pages.

U.S. Appl. No. 16/839,657, filed Apr. 3, 2020, Derelöv.

**Derelöv, Peter, U.S. Appl. No. 16/839,657, entitled "Automated Assembly," filed in the U.S. Patent and Trademark Office on Apr. 3, 2020.

* cited by examiner

METHOD AND DEVICE FOR INSERTING A TONGUE

CROSS REFERENCE TO RELATED APPLICATIONS

The present application claims the benefit of Swedish Application No. 650941-6, filed on Jun. 29, 2016. The entire contents of Swedish Application No. 1650941-6 are hereby incorporated herein by reference in their entirety.

FIELD OF THE INVENTION

Embodiments of the present invention relate to methods and devices for inserting tongue into an insertion groove in a panel. The panel is configured to be arranged and locked perpendicular to an adjacent panel by a locking device comprising the tongue. The panels may be assembled and locked together to obtain a furniture product, such as a bookshelf, a cupboard, a wardrobe, a box a drawer or a furniture component.

BACKGROUND OF THE INVENTION

A conventional furniture product may be assembled by a plurality of elements or panels. The panels may be assembled with a mechanical locking device such as disclosed in, for example, WO 2012/154113 A1. The product comprises a first panel connected perpendicularly to a second, panel by a mechanical locking device comprising, an edge tongue at the first panel, an edge groove at the second panel and a flexible tongue in an insertion groove.

WO 2015/038059 discloses a product assembled by a plurality of panels that are locked by mechanical locking devices comprising a flexible tongue in an insertion groove.

The locking devices of the panels re generally produced in a production line by a continuous production process, comprising a number of milling tools. The edge groove and the insertion groove may extend contiguously from a front edge to a back edge of the panel. The edge groove is preferably covered at the front edge by a decorative layer. The edge groove and the insertion groove may also end before the front edge and/or the back edge as disclosed in, e.g., SE 1650135-5.

Embodiments of the present invention address a need to provide an improved method and an improved device for inserting a tongue into an insertion groove in a panel.

SUMMARY OF THE INVENTION

Accordingly, embodiments of the present invention preferably seek to mitigate, alleviate or eliminate one or more deficiencies, disadvantages or issues in the art, such as the above-identified, singly or in any combination by providing a method for inserting a tongue in an insertion groove in a panel.

A further object of embodiments of the invention is to provide an improve method for inserting a tongue in an insertion groove comprising displacing the tongue in a tongue queue device by compression forces from tongues in the tongue queue.

Embodiments of the invention may have the advantages that the tongue is guided in a reliable manner by a tongue queue device to an inserting device. The tongue queue device may have the advantage that the tongue may be fed to an outlet of the tongue queue device, which is adjacent an inlet of the inserting device, wherein the height and/or the angle of the outlet may be chosen with a great freedom.

At least some of these and other objects and advantages that will be apparent from the description have been achieved by a first aspect of the invention comprising a method for inserting a tongue in an insertion groove in a panel, wherein the method comprises:

- displacing a first tongue to an end position of a tongue queue, which comprises tongues under compression, in a tongue queue device,
- compressing the first tongue,
- displacing the tongues in the tongue queue by compression forces from the tongues under compression,
- displacing a second tongue, which is at a front position of the tongue queue, to an inserting device,
- displacing the second tongue into an insertion groove in a panel by said inserting device.

The tongues in the tongue queue are preferably at least partly displaced by compression forces from the tongues under compression.

The tongues in the tongue queue may be displaced only by the compression forces when the second tongue is displaced into the inserting device.

The first tongue may be displaced by a device to the end position of the tongue queue, wherein the device may indirectly displace some or all of the tongues under compression the tongue queue.

The method may comprise separating the first tongue from a tongue blank by a separating device.

The method may comprise performing said compressing by the separating device.

The method may comprise performing said separating and compressing by rotating a tool.

The method may comprise displacing the first tongue from the end position to the front position, preferably between an upper curve shaped surface and lower curve shaped surface of the tongue queue device.

The method may comprise rotating the first tongue during said displacing of the first tongue from the end position to the front position.

The method may comprise displacing the first tongue in a first direction and in a second direction, which is perpendicular to the first direction, during said displacing of the first tongue from the end position to the front position.

A second aspect of the invention comprises a machine for inserting a tongue in an inserting groove in a panel, wherein the machine comprises a tongue queue device comprising an upper surface and an opposite lower surface configured to guide tongues from an inlet to an outlet of the tongue queue device. The machine comprises a separating device, preferably at the inlet of the tongue queue device, which is configured to compress the tongues, that the tongue queue device is configured such that tongues under compression in a tongue queue are displaced between the inlet and the outlet at least partly by compression forces from the tongues under compression, and that the machine comprises, at the outlet of the tongue queue device, an inserting device which is configured to displace a tongue into the insertion groove.

The upper surface and the lower surface may be curve shaped.

A first tangential direction of the upper surface and/or the lower surface at the inlet may be different from a second tangential direction of the upper surface and/or the lower surface at the outlet.

The inlet may be positioned in a first vertical position and in a first horizontal position and the outlet may be positioned in a second vertical position and a second horizontal position, wherein the first vertical position is different from the second vertical position, and wherein the first horizontal position is different from the second horizontal position.

The separating device may be configured to separate a tongue from a tongue blank by a tool which is rotatable.

The upper surface may, be at an edge of an upper plate shaped element and the lower surface may be at an edge of a lower plate shaped element.

The machine may comprise two or more of said upper plate shaped element, preferably arranged at a distance from each other and preferably parallel to each other, and wherein the device comprises two or more of said lower plate shaped element, preferably arranged at a distance from each other and preferably parallel to each other.

The first tongue and the second tongue and the tongues in the tongue queue are preferably identical or essentially identical to the tongue.

The first tongue and the second tongue and the tongues in the tongue queue, according to the first and/or second aspect may comprise one or more of the features of the tongues below:

The tongue may be of an elongated shape and may comprise a first long edge and a second-long edge. The first edge may be a first short edge, and the second edge may be an opposite second short edge.

A longitudinal direction of the tongue is preferably perpendicular to the first direction.

The tongue may be a flexible tongue and made of, e.g., a polymer and preferably comprising a reinforcement material, such, as a fibre e.g. fiberglass.

The tongue may comprise a bendable part at the first long edge and preferably a groove adjacent the bendable part. The bendable part may be configured to be pushed into the groove adjacent the bendable part. The tongue may comprise several of said bendable part and preferably several of said groove.

The tongue may comprise a polymer material and is preferably produced by injection moulding.

The tongue may be connected to several tongues in the tongue blank by a first rail at the first short edge and preferably by a second rail at the second short edge. A separating device preferably separates the tongue from the first rail and preferably from any second rail before the tongue is displaced to the tongue queue of a tongue queue device.

The first rail and the second rail may extend in a length direction perpendicular to the tongue.

The tongue may be connected to the first rail and/or the second rail, which may be casting gates, by a first and a second casting gate, respectively The tongue is preferably configured to be displaceable in the insertion groove.

The device is preferably a part of a production line comprising milling tools for forming a locking device at the edge of the panel. The locking device preferably comprises said insertion groove.

The edge groove and the insertion groove may extend contiguously from a front edge to a back edge of the panel.

BRIEF DESCRIPTION OF THE DRAWINGS

These and other aspects, features and advantages of which embodiments of the invention are capable of, will be apparent and elucidated from the following description of embodiments of the present invention, reference being made to the accompanying drawings, in which.

DESCRIPTION OF EMBODIMENTS

Specific embodiments of the invention will now be described with reference to the accompanying drawings. This invention may, however, be embodied in many different forms and should not be construed as limited to the embodiments set forth herein; rather, these embodiments are provided so that this disclosure will be thorough and complete, and will fully convey the scope of the invention to those skilled in the art. The terminology used in the detailed description of the embodiments illustrated in the accompanying drawings is not intended to be limiting of the invention the drawings, like numbers refer to like elements.

Figure 1:
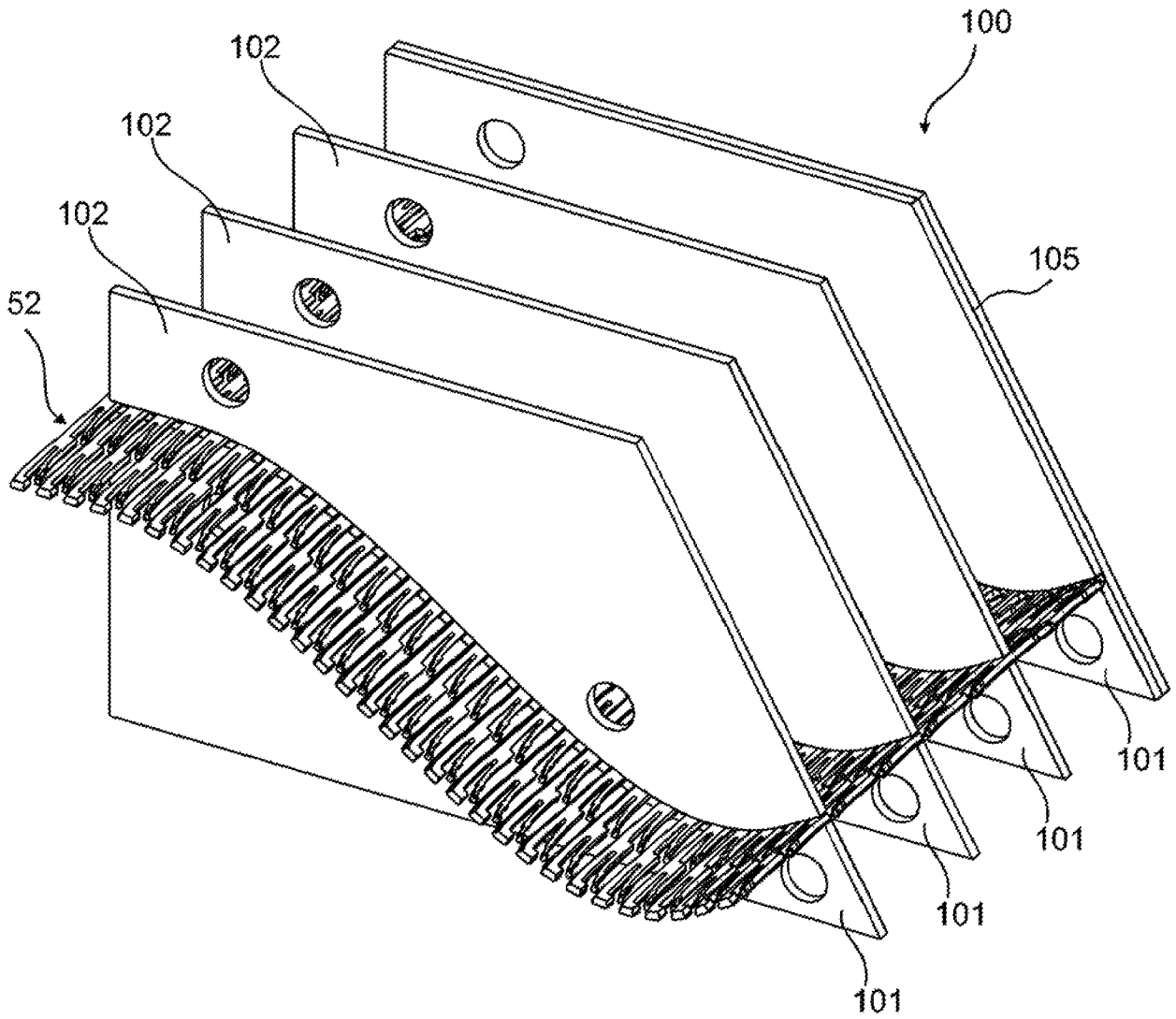
FIG. 1 shows tongue queue device in a 3D-view according to an embodiment of the invention.
Figure 2:
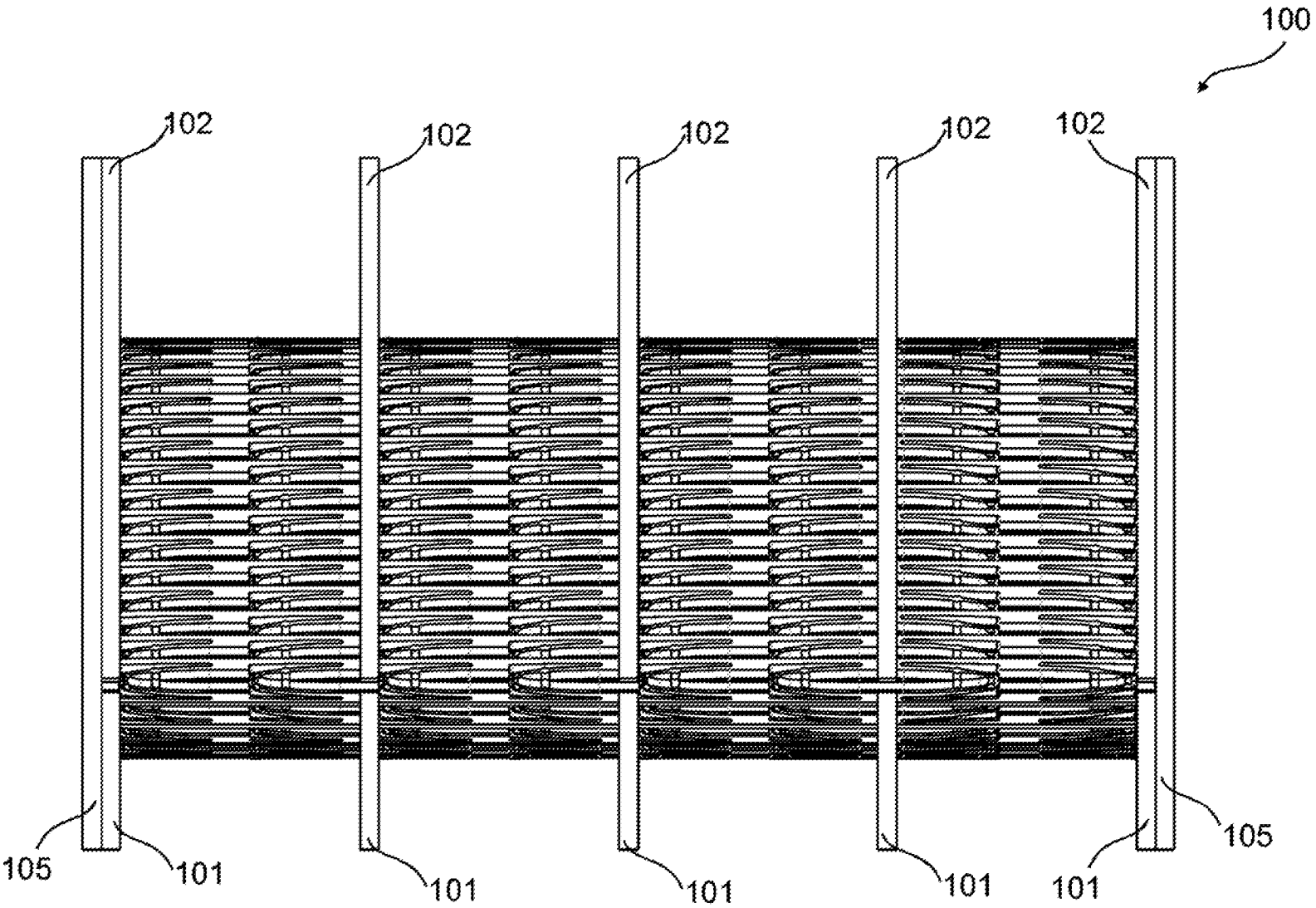
FIG. 2 shows a tongue queue device in a front view, according to an embodiment of the invention.
Figure 3:
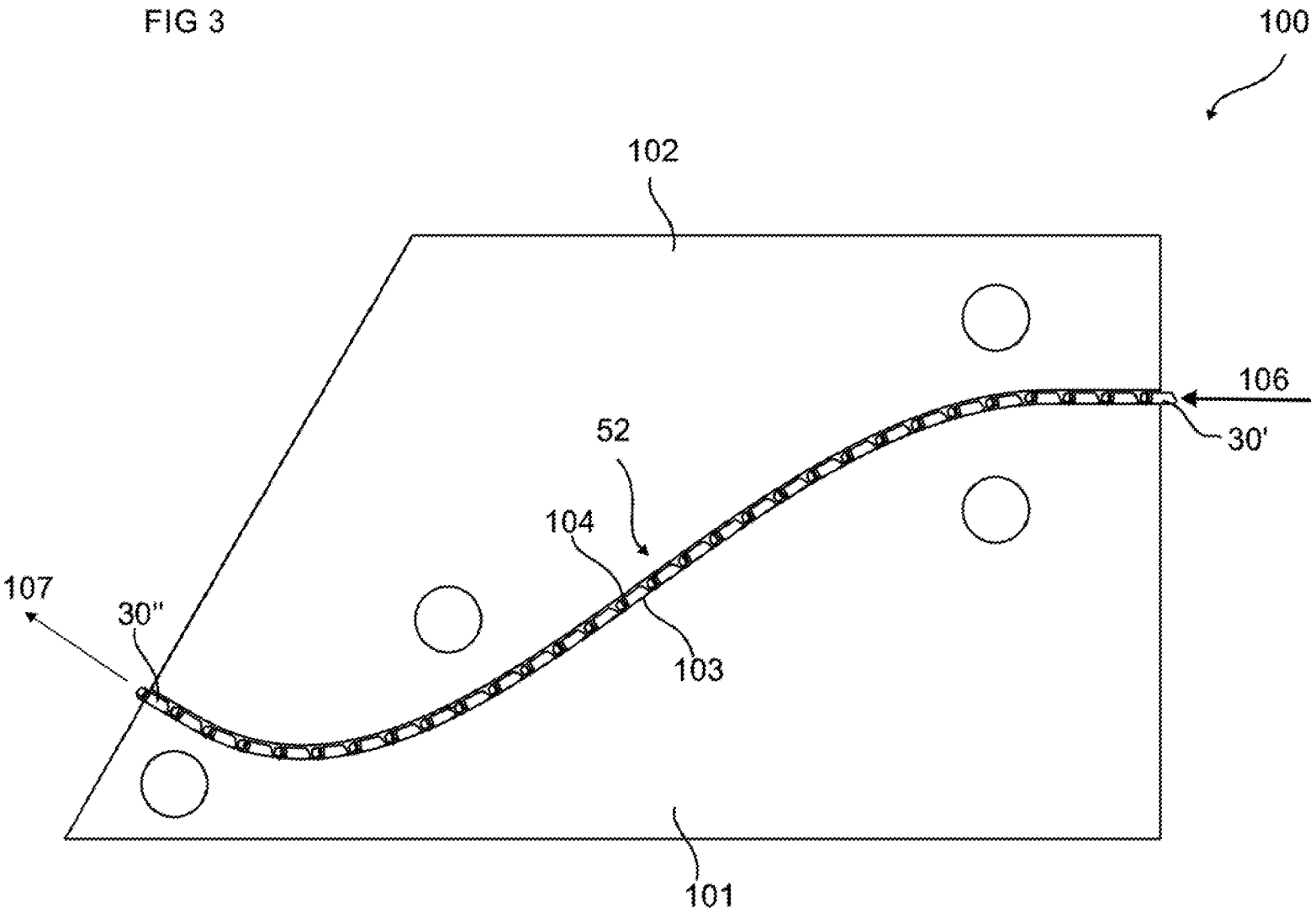
FIG. 3 shows a tongue queue in a side view, according to an embodiment of the invention.
Figure 4:
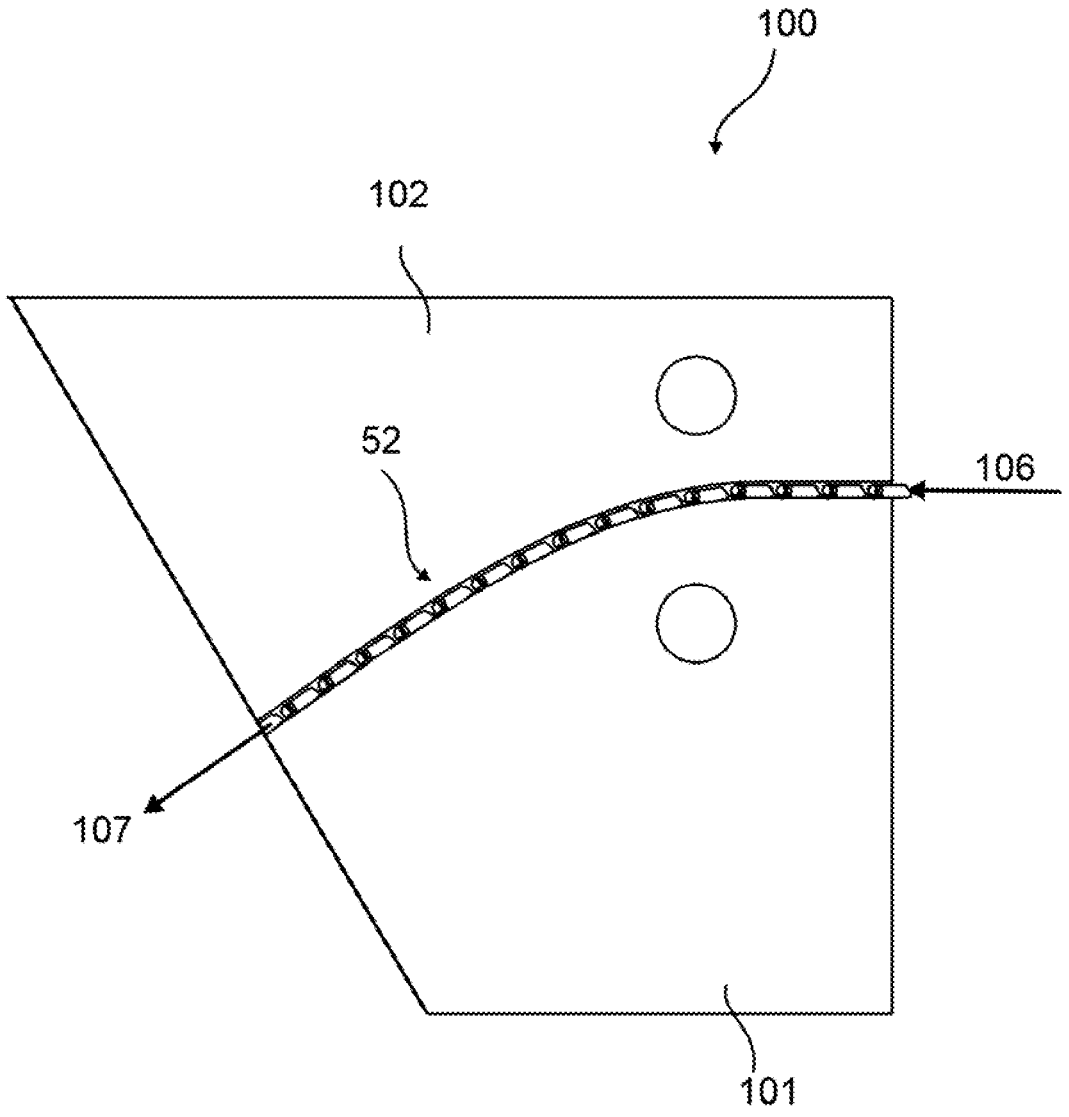
FIG. 4 shows a tongue queue in a side view, according to embodiment of the invention.

Embodiments of the tongue queue device 100 and embodiments of the method for displacing the tongue in the tongue queue device are shown in FIG. 1 to FIG. 4. The method and the machine for inserting a tongue into an insertion groove in a panel preferably comprise some of these embodiments. FIG. 1 shows an embodiment of tongue queue device 100 in a 3D-view, FIG. 2 shows the embodiment device in a front view, FIG. 3 shows the embodiment in a side view FIG. 4 shows another embodiment 100 of tongue queue in a side view.

Embodiments of the method for displacing the tongue in the tongue queue device comprise;

- displacing a first tongue 30' to an end position of a tongue queue 52, which comprises tongues 30 under, compression, in a tongue queue device 100,
- compressing the first tongue 30',
- displacing the tongues 30 in the tongue queue 52, at least partly by compression forces from the tongues 30 under compression,
- displacing a second tongue 30", which is at a front position of the tongue queue, to an inserting device 80,
- displacing the second tongue 30", into an insertion groove 20 in a panel by said inserting device 80.

The tongues 30 in the tongue queue 52 may be displaced only by the compression forces when the second tongue 30" is displaced into the inserting device 80.

The first tongue 30' may be displaced by a device to the end position of the tongue queue, wherein the device may indirectly displace some or all of the tongues under compression in the tongue queue 52.

When the first tongue 30' is at the end position of the tongue queue 52, the compressing of the first tongue 30' is a compressing in a direction 106.

Each tongue may follow a tongue queue path from an end position of the tongue queue to the front position of the tongue queue. The compression forces of the tongues 30 in the tongue queue 52 are in the direction of the tongue queue path.

The method may comprise separating the first tongue 30' from a tongue blank 50 by a separating device 110.

The method may comprise performing said compressing by the separating device 110.

The method may comprise performing said separating and compressing by rotating a tool 60.

The method may comprise displacing the first tongue 30' from the end position to the front position, preferably between an upper curve shaped surface 104 and lower curve shaped surface 103 of the tongue queue device 100.

The method may comprise rotating the first tongue 30' during said displacing of the first tongue from the end position to the front position. For example, the first tongue may be rotated at least 15°. For example, the first tongue, may be rotated at least 5° in one direction followed by rotation of at least 10° in an opposite direction.

The method may comprise displacing the first tongue 30' in a first direction and in a second direction, which is perpendicular to the first direction, during said displacing of the first tongue from the end position to the front position.

Embodiments of the tongue queue device 100, may comprise an upper surface 104 and an opposite lower surface 105 configured to guide tongues 30 from an inlet to an outlet of the tongue queue device. The queue device is configured such that tongues 30 under compression in a tongue queue 52 are displaced between the inlet and the outlet at least partly by compression forces from the tongues 30 under compression.

The upper surface 104 and the lower surface 103 may be curve shaped. For example, the upper surface and the lower surface may include one inflection point, two inflection points, or more.

A first tangential direction 106 of the upper surface and/or the lower surface at the inlet is different from a second tangential direction 107 of the upper surface and/or the lower surface at the outlet.

The embodiment of the tongue queue device shown in FIG. 4 is configured for inserting a tongue in, downward direction. The embodiment of the tongue queue device shown in FIGS. 1-3 is configured for inserting a tongue in an upward direction.

The inlet may be positioned in a first vertical position and in a first horizontal position and the outlet may be positioned in a second vertical position and a second horizontal position, wherein the first vertical position is different from the second vertical position, and wherein the first horizontal position is different from the second horizontal position. For example, the outlet may be lower than the inlet, and the second tangential direction may be in a upward direction, for example, in a range of 5 to 45°, and may be more upward directed than the first tangential direction, for example by about 5 to 60°. For example, the outlet may be lower than the inlet and the second tangential direction may be in a downward direction, for example, in a range of 5 to 45°, and may be more downward directed than the first tangential direction, for example by about 5 to 60°.

The upper surface 104 may be at an edge of an upper plate shaped element 102 and the lower surface 103 is at an edge of a lower plate shaped element 101.

The tongue queue device may comprise two or more of said upper plate shaped element 102, preferably arranged at a distance from each other and preferably parallel to each other, and wherein the tongue queue device comprises two or more of said lower plate shaped element 101, preferably arranged at a distance from each other and preferably parallel to each other.

Figure 5A:
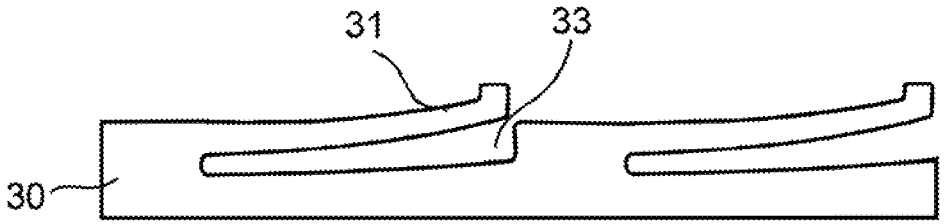
FIGS. 5A-5D show embodiments of the tongue according to embodiments of the invention.
Figure 5B:
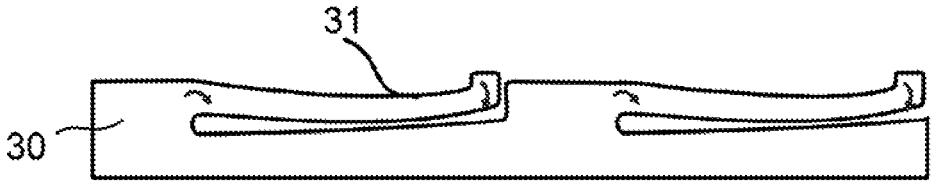
Figure 5C:
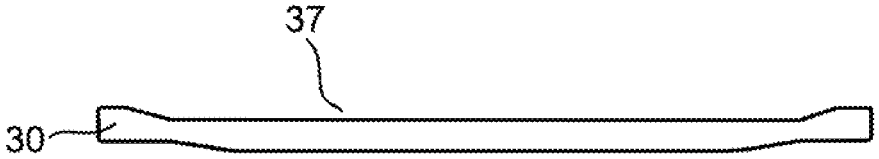
Figure 5D:
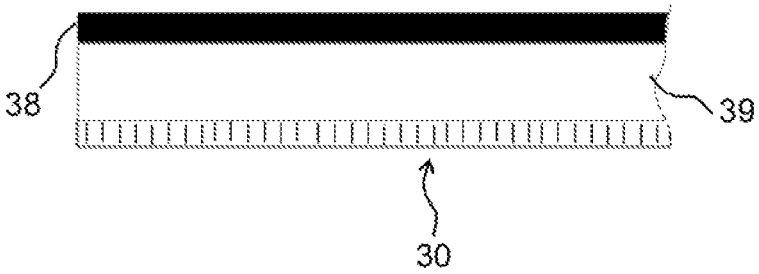

Embodiments of a tongue, which may be the first tongue, the second tongue and the tongues in the tongue queue 30, which may be displaceable in an insertion groove 20, see FIGS. 7A-7D, are shown in FIGS. 5A-5D. A first embodiment of the tongue, which is shown in FIGS. 5A-5B, comprises bendable protruding parts 31 at a first long edge of the tongue. The first embodiment is shown in a relaxed state in FIG. 5A and in a compressed state in FIG. 5B. A second long edge of the tongue is preferably essentially straight. The first embodiment may be inserted into the insertion groove with the bendable protruding parts facing towards a bottom of the insertion groove and the second edge extending beyond an opening of the insertion groove. A second embodiment of the tongue, which is shown in FIG. 5C in a relaxed state, is of an elongated shape, and flexible. The second embodiment comprises a recess 37 at a first long edge of the tongue and a second edge which is essentially straight. The recess is decreased in a compressed state of the second embodiment. The second embodiment may be inserted into the insertion groove with the recess 37 facing towards a bottom of the insertion groove and the second edge extending beyond an opening of the insertion groove. A third embodiment of the tongue, which is shown in FIG. 5D, comprises a first part 38, which is flexible and configured to be compressed, and a second part 39 which is rigid. The first part may be arranged in the insertion groove and the second part may partly extend beyond an opening of the insertion groove.

The tongue may be configured as any of the embodiments of the displaceable tongue disclosed in, e.g., WO 2006/043893 and WO 2007/015669, the entire contents of which are hereby expressly incorporated herein by reference.

The tongue may be flexible and made of, e.g., a polymer and preferably comprising a reinforcement material, such as a fibre, e.g., fiberglass.

Figure 6A:
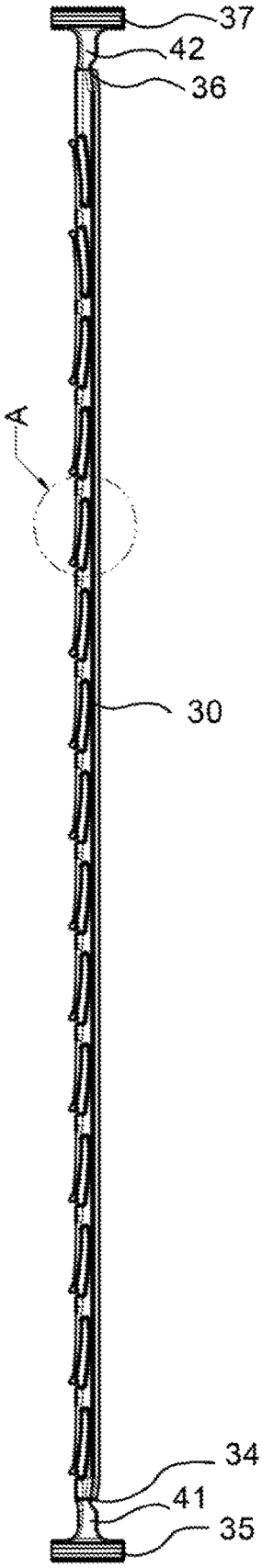
FIGS. 6A-6D how an embodiment of the tongue according to an embodiment of the invention.
Figure 6B:
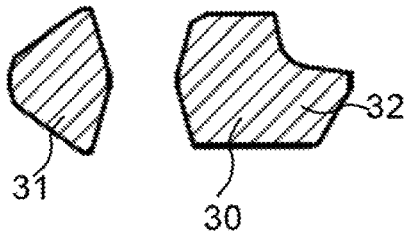
Figure 6C:
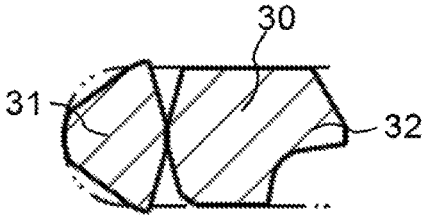
Figure 6D:
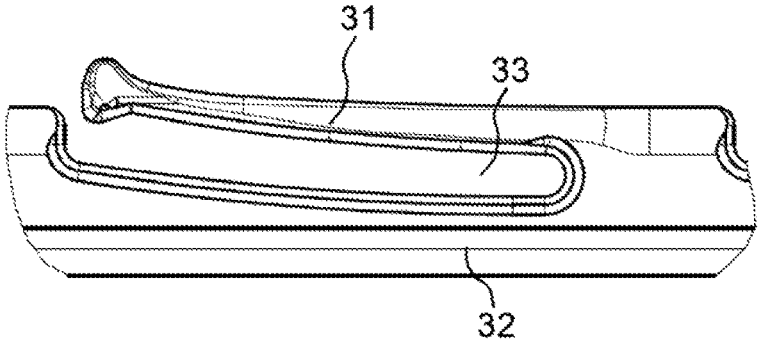

Another embodiment of the tongue 30 is shown in FIGS. 6A-6D. The tongue is of an elongated shape and comprises a first short edge 34, an opposite second short edge 36, first long edge and a second long edge 32. FIG. 6D shows an enlargement of the encircled area A indicated in FIG. 6A. The tongue comprises several bendable parts 31 at the first long edge and a groove 33 at each bendable part 31. The tongue comprises a polymer material and is preferably produced by injection moulding. The bendable part 31 is configured to be pushed into the groove 33 in a compressed state of the tongue.

FIG. 6A shows an embodiment of tongue which is connected to several tongues (not shown) in a tongue blank by a first rail 35 at the first short edge 34 and by a second rail 37 at the second short edge 36. The first rail and the second rail extend in a length direction perpendicular to the tongue. The tongue may be connected to the first rail and/or the second rail, which may be casting gates, by a first and a second casting gate 41, 42, respectively.

FIG. 6B and FIG. 6C show the tongue 30 in a cross cut view. The tongue is in FIG. 6B in a relaxed state an in FIG. 6C in a compressed state. A distance between an outer part of the bendable part 31 and the second long edge 32 is shorter in the compressed state compared to in the relaxed state.

The tongue is preferably configured to be inserted into an insertion groove of a panel for locking the panel to an adjacent panel.

FIGS. 7A-7D shows embodiments of the panel 1, each comprising an embodiment of the tongue 30 inserted in an embodiment of the insertion groove 20, connected to an adjacent panel 2. The embodiments of the panel shown in FIGS. 7A-7D may be furniture panels. The embodiment of the panel shown in FIG. 7C may also be a floor panel.

Figure 7A:
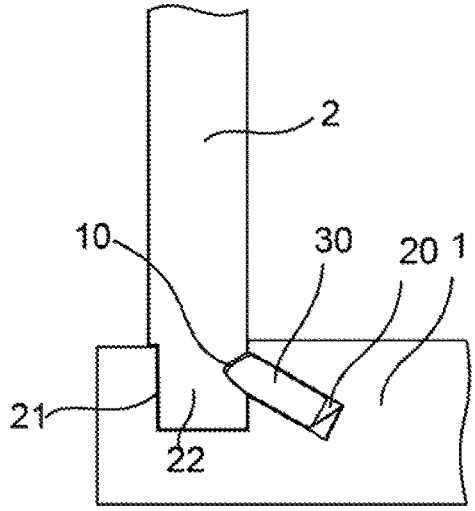
FIGS. 7A-7D show embodiments of the panel according to embodiments of the invention.

FIG. 7A shows the panel 1 arranged perpendicular to an adjacent panel 2 and locked to the adjacent panel in a first direction and in a second direction, which is perpendicular to the first direction. The panel comprising an edge groove 21 at an upper surface of the panel. The edge groove 21 is of a longitudinal shape and extends along an edge of the panel 1. The edge groove comprising said insertion groove 20, which is extending along the edge groove, comprising said tongue 30. The adjacent panel comprises an edge tongue 22 which comprises a tongue groove 10 extending along an edge of the adjacent panel. The tongue 30 is configured to cooperate with the tongue groove 10 for locking together the panel 1 with the adjacent panel 2 in the first direction. The edge tongue 22 is configured to cooperate with the edge groove 21 for locking together the panel 1 with the adjacent panel 2 in the second direction.

Figure 7B:
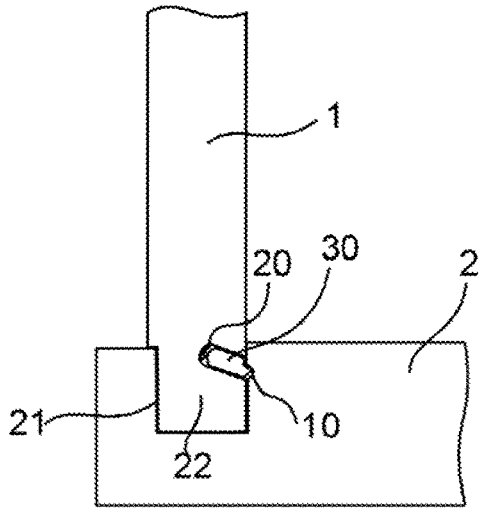

FIG. 7B shows the panel 1 arranged perpendicular to a adjacent panel 2 and locked to the adjacent panel in a first direction and in a second direction, which is perpendicular to the first direction. The adjacent panel comprising an edge groove 21 at an upper surface of the adjacent panel. The edge groove 21 is of a longitudinal shape and extends along an edge of the adjacent panel 1. The edge groove comprises a tongue groove 10. The panel comprises an edge tongue 22 which comprises said insertion groove 20 comprising said tongue 30. The insertion groove is extending along the edge tongue. The tongue 30 is configured to cooperate with the tongue groove 10 for locking together the panel 1 with the adjacent panel 2 in the first direction. The edge tongue 22 is configured to cooperate with the edge groove 21 for locking together the panel 1 with the adjacent panel 2 in the second direction.

Figure 7C:
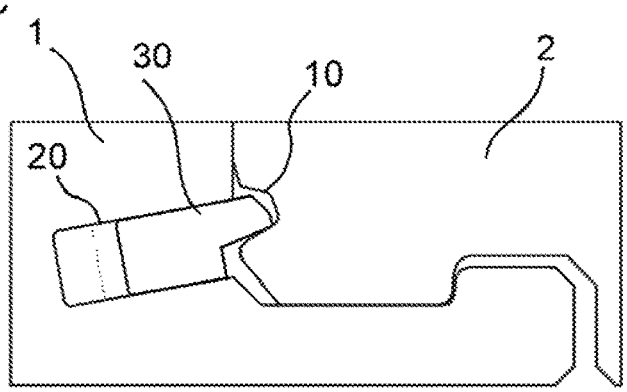

FIG. 7C shows the panel 1 arranged parallel to an adjacent panel 2 and locked to the adjacent panel its a first direction and in a second direction which is perpendicular to the first direction. The panel comprising said insertion groove 20 which is extending along an edge of the panel. The edge comprises a strip protruding from the edge and the strip comprises an upwardly protruding locking element. The adjacent panel 2 comprises a tongue groove 10 extending along an adjacent edge of the adjacent panel 2. The adjacent edge comprises a locking groove with an opening facing downwards. The tongue 30 is configured to cooperate with the tongue groove 10 for locking the panel to the adjacent panel in a first direction and the locking element is configured to cooperate with the locking groove for locking the panel to the adjacent panel in the second direction. An embodiment of the said first and second panel comprises the insertion groove 20 at the adjacent edge of the adjacent panel and the tongue groove 10 at the edge of the panel.

Figure 7D:
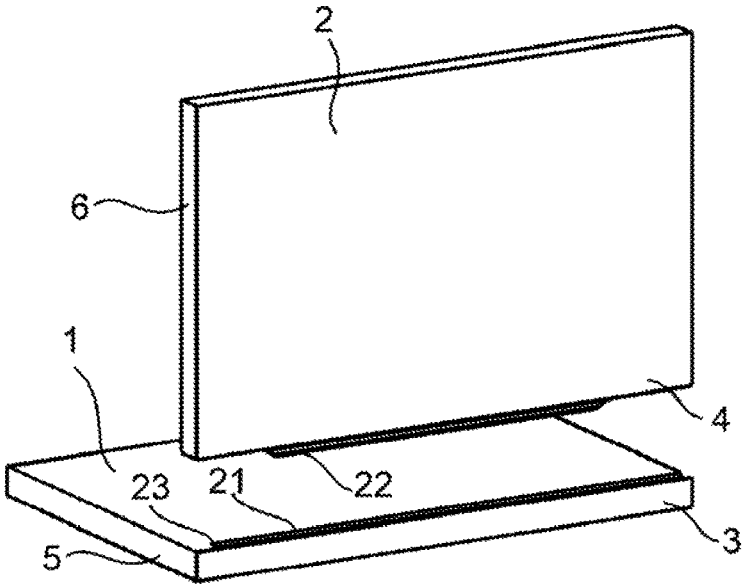

FIG. 7D shows an embodiment of the panel and the adjacent panel shown in FIG. 6A in a 3D-view. The edge tongue 22 is extending along the edge 4 of the adjacent panel and ends before an adjacent edge 6 of the adjacent panel 2. The edge groove 21 is extending along the edge 3 of the panel 1 and ends at a side wall 23 before an adjacent edge of the 5 of the panel 1.

A core material of embodiments of the panel and the adjacent panel described above may comprises a wood fibre based, board, such, as a HDF, MDF, plywood, solid wood or particleboard, or a reinforced plastic board or a wood fibre composite board. The core, may be provided with a decorative layer.

Figure 8A:
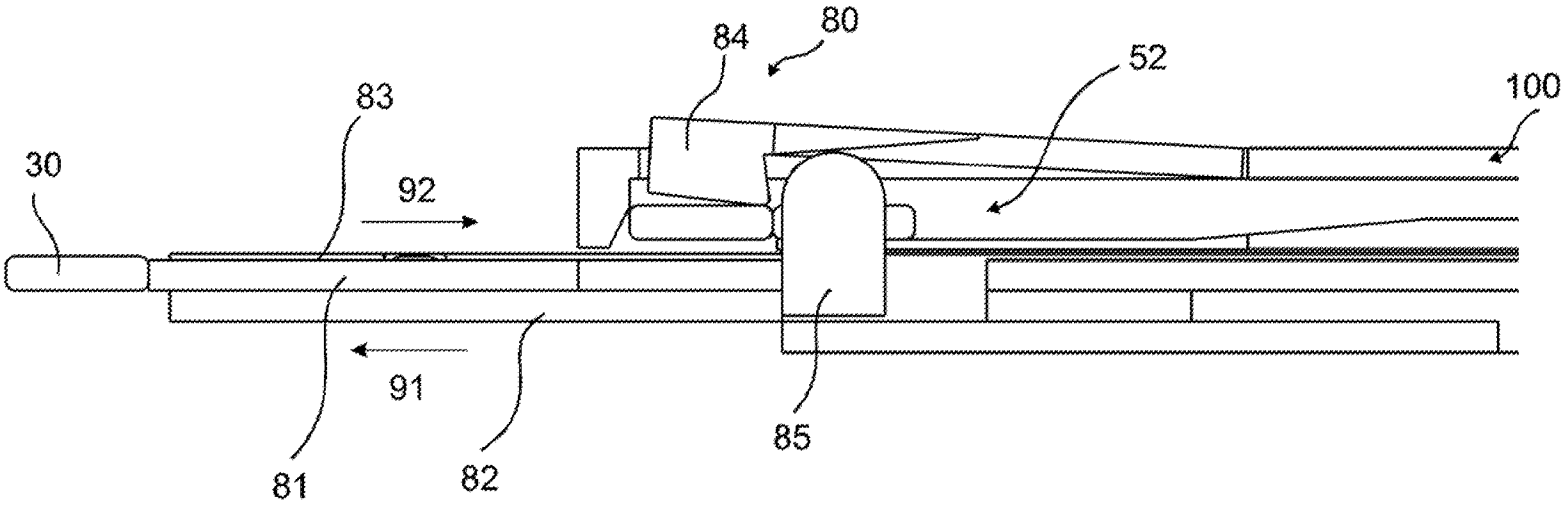
FIGS. 8A-8B show an inserting device, according to an embodiment of the invention.
Figure 8B:
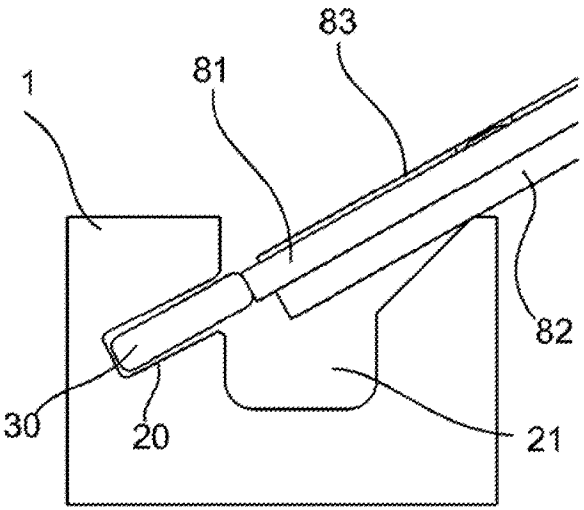

An embodiment of an inserting device 80 is shown in FIGS. 8A and 8B in an outer end position. FIG. 8B shows an embodiment of a panel 1 comprising an insertion groove 20 in an edge groove 21, the tongue 30, a puncher 81 and a first part 83 and, a second part 82 of a tongue guiding device. The tongue guiding device is displaced to a position close to an opening of the insertion groove. The distance between the tongue guiding device and the opening is preferably about 1 mm or may be in the range of about 0.5 mm to about 2 mm. The device comprises a tongue guiding device, which is displaceable in a first direction 91, and a puncher 81 which is configured to displace a tongue 30 between a first part 83 and a second part 82, into an insertion groove 20 in a panel, wherein the tongue guiding device is configured to be displaced by the puncher, which is displaceable in the first direction 91.

The embodiment comprising a panel with an upwardly directed edge groove and the first direction is, downwardly inclined.

The puncher 81 may be displaceable a longer distance in the first direction than the tongue guiding device.

The first part 83 of the tongue guiding device may be displaceable a longer distance in the first direction than the second part 82 of the guiding device.

The device may comprise a displaceable tongue queue stopper 84 for controlling a feeding of a new tongue, the tongue queue stopper 84 is preferably configured to cooperate with a protruding part 85 on the tongue guiding device.

The puncher 81 and the tongue guiding device may be displaceable in relation to a tongue queue device 100.

The device may comprise a motor (not shown), such as an electric motor or a pneumatic motor, configured to drive the puncher 81 in the first direction 91 and preferably in a second direction 92, which is opposite to the first direction.

An advantage of this embodiment of the device may be that only one motor is required to drive the puncher, the guiding device and the tongue queue stopper.

Figure 9A:
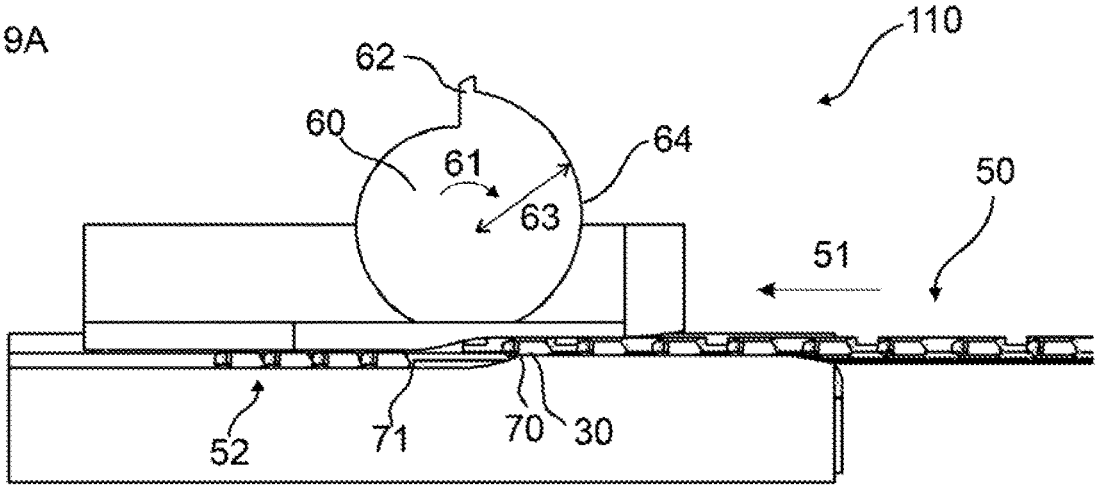
FIGS. 9A-9D show a separating device, according to an embodiment of the invention.
Figure 9B:
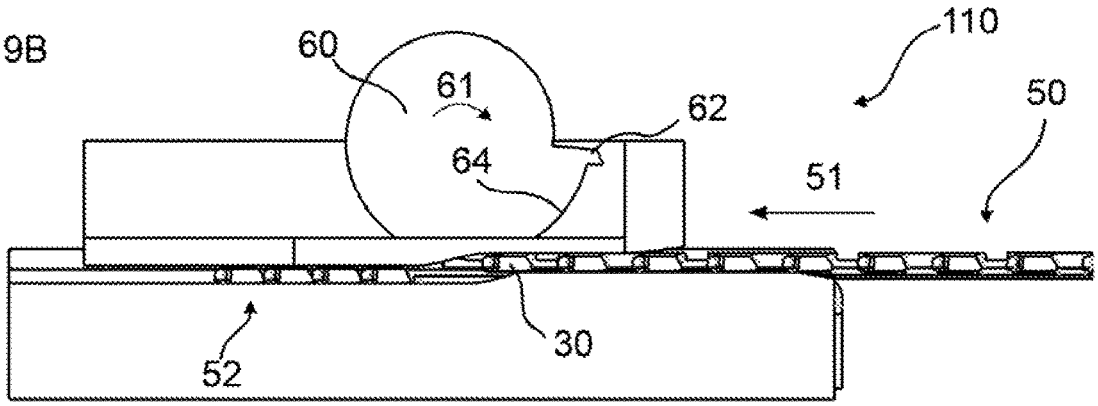
Figure 9C:
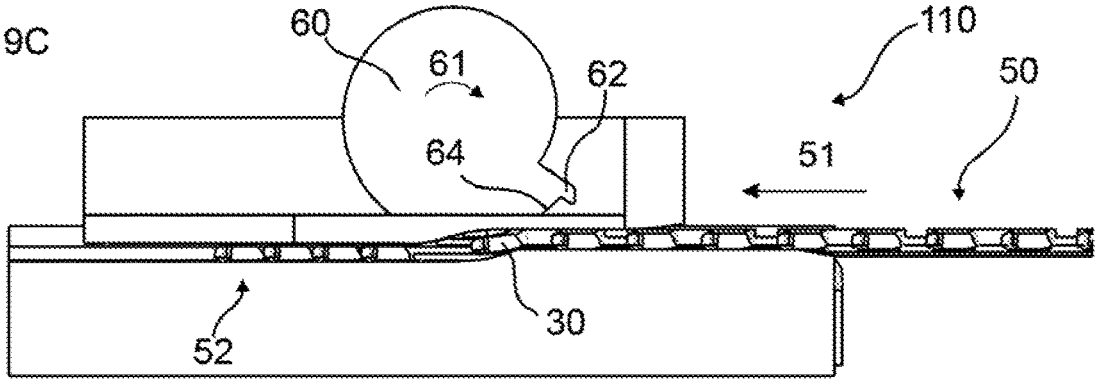
Figure 9D:
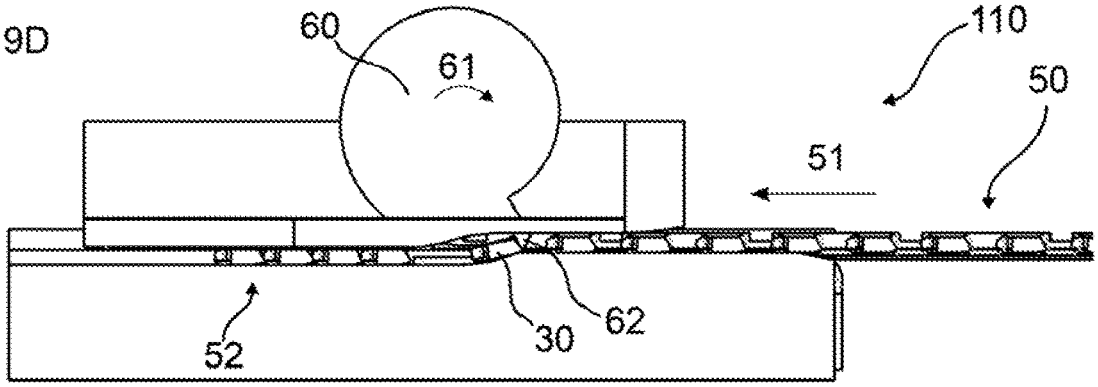

An embodiment of the separating method and the separating device 110 is shown in a side view in FIGS. 9A-9D from a starting position in FIG. 9A, with a protruding part of a rotatable tool facing upwards, to a position of contact between the protruding part and the tongue in FIG. 9D. The method comprises a method for managing and separating a tongue from a tongue blank, comprising cutting a first edge 34 of a tongue 30 from a tongue blank 50 by rotating 61 a tool 60 which comprises a protruding part 62, and displacing the tongue 30 by the protruding part 62 to a tongue queue 52. The tongue queue preferably comprises two or more tongues which are preferably identical or essentially identical to said tongue.

The tongue blank 50 is displaced in a feeding direction 51 towards the tool until a tongue of the tongue blank has reached a cutting position in the device 110.

A rail of the tongue blank 50 may have a length direction parallel to the feeding direction 51.

A longitudinal direction of the tongue 30, at the time of feeding and separation from the tongue blank, is preferably parallel to an axis of rotation of the rotatable/rotating tool 60.

The device may comprise a dye 76 and the tongue is cut between the tool and the dye. The tongue 30 is preferably displaced by the protruding part 62 when the tongue 30 is separated or almost separated from the tongue blank 50.

The method may comprise rotating the tool 60 by a shaft, wherein the shaft comprises a rotating disc, and guiding the tongue by the rotating disc during the cutting. The disc may have the same shape as the tool, and, the device may comprise a free space under the disc, such that the tongue is guided and displaced without cutting the tongue apart.

The method preferably comprises cutting a second edge of the tongue 30 from the tongue blank 50 by a second of said rotating tool 60.

The method may comprise compressing said tongue 30 by the protruding part 62.

The method may comprise compressing the tongues in tongue queue 52, by the protruding part 62.

The method may comprise displacing the tongue by the protruding part 62, during the cutting, from an upper inlet to a lower outlet.

The method preferably comprises further rotating the tool 60 in the same direction 61 from the contact position in FIG. 9D until the tool has reached the starting position in FIG. 9A.

Figure 10:
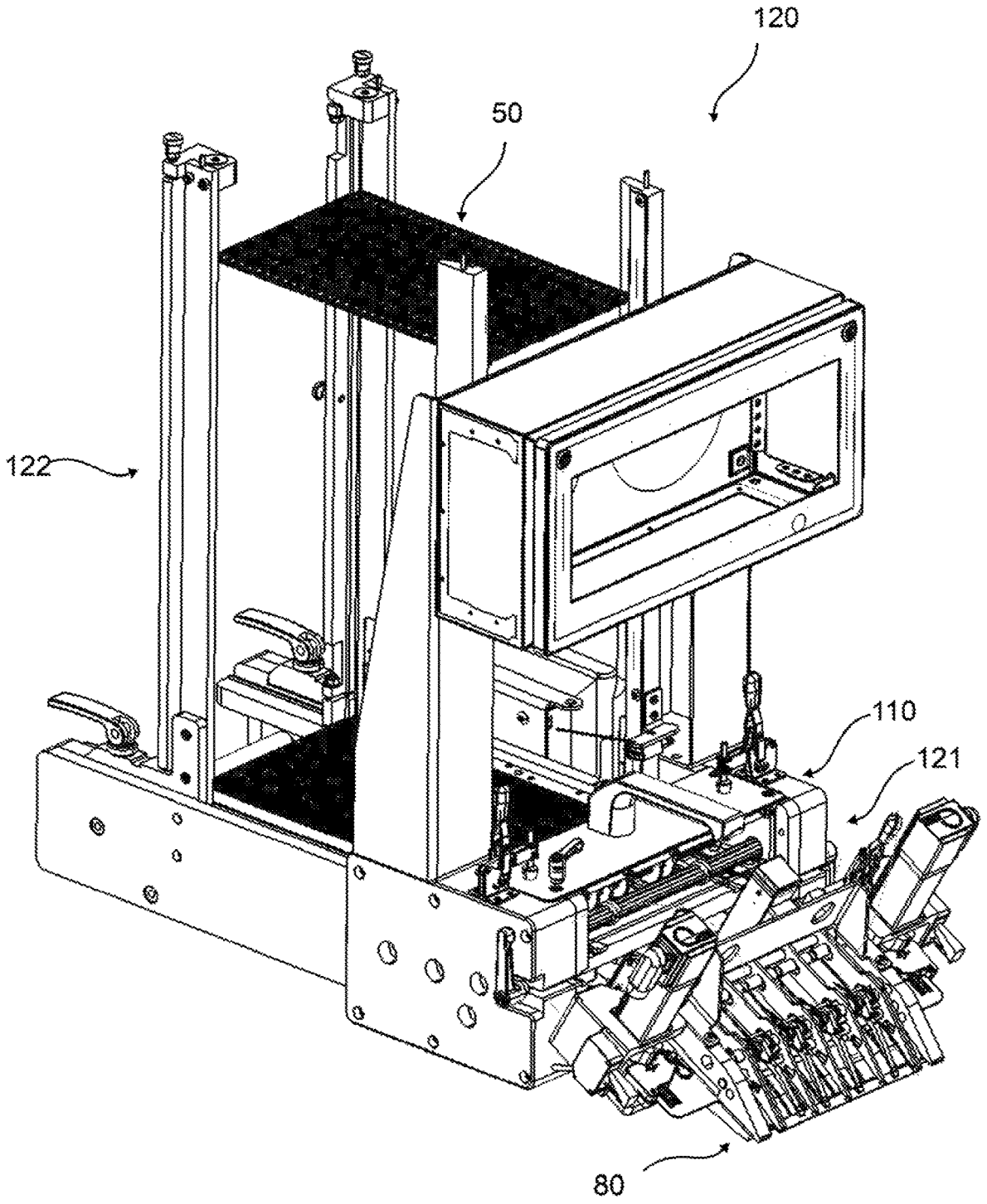
FIG. 10 shows a machine, according to an embodiment of the invention.

An embodiment of the machine for inserting a tongue in an inserting groove 20 in a panel is shown in FIG. 10. The machine comprises a tongue queue device 100, see FIGS. 1-4, comprising an upper surface 104 and an opposite lower surface 105 configured to guide tongues 30 from an inlet to an outlet of the tongue queue device. The device comprises a separating device 110, see FIGS. 9A-9D, preferably at the inlet, configured to compress the tongues 30, that the device is configured such that tongues 30 under compression in a tongue queue 52 are displaced between the inlet and the outlet by compression forces from the tongues 30 under compression, and that the machine comprises an inserting device 100 at the outlet configured to displace a tongue into the insertion groove 20.

FIG. 10 shows the machine before attachment of the tongue queue device at a position 21 between the separating device and the inserting device.

The upper surface 104 and the lower surface 103 may be curve shaped.

A first tangential direction 106 of the upper surface and/or the lower surface at the inlet is different from a second tangential direction 107 of the upper surface and/or the lower surface at the outlet.

The machine shown in FIG. 10 preferably comprises the embodiment of the tongue queue device shown in FIG. 4 since the machine is configured for inserting a tongue in downward direction and comprises an inserting device facing downwards. An embodiment of the machine which is configured for inserting a tongue in an upward direction, comprises an inserting device directed upwards and preferably comprises the embodiment of the tongue queue device shown in FIG. 3. The same machine may be used for inserting a tongue in an upward direction and in the downward direction by replacing the embodiment of tongue queue device and adjusting the angle of the inserting device.

The inlet may be positioned in a first vertical position and in a first horizontal position and the outlet may be positioned in a second vertical position and a second horizontal position, wherein the first vertical position is different from the second vertical position, and wherein the first horizontal position is different from the second horizontal position.

The separating device may be configured to separate tongue from a tongue blank by a tool 60 which is rotatable see FIGS. 9A-9D.

The upper surface 104 may be at an edge of an upper plate shaped element 102 and the lower surface 103 is at an edge of a lower plate shaped element 101.

The tongue queue device may comprise two or more of said upper plate shaped element 102, preferably arranged at a distance from each other and preferably parallel to each other, and wherein the tongue queue device comprises two or more of said lower plate shaped element 101, preferably arranged at a distance from each other and preferably parallel to each other.

The machine may also comprise a magazine 122 for tongue blanks 50.

The machine may be arranged in a production line comprising milling tools for forming a locking device, comprising the insertion groove 20, at an edge of the panel for locking the panel to an adjacent panel. The panel is preferably contiguously displaced during the insertion of the tongue into the insertion groove.

Embodiments

1. A method for inserting a tongue in an insertion groove in a panel, wherein the method comprises:
   - displacing a first tongue (30') to an end position, of a tongue queue (52), which comprises tongues (30) under compression, in a tongue queue device (100),
   - compressing the first tongue (30'),
   - displacing the tongues (30) in the tongue queue (52) at least partly by compression forces from the tongues (30) under compression,
   - displacing a second tongue (30"), which is at a front position of the tongue queue, to an inserting device (80),
   - displacing the second tongue (30") into an insertion groove (20) in a panel by said inserting device (80).

2. The method as in embodiment 1, comprising separating the first tongue (30') from a tongue blank (50) by a separating device (110).

3. The method as in embodiment 2, comprising performing said compressing by the separating device (110).

4. The method as in embodiment 3, comprising performing said separating and compressing by rotating a tool (60).

5. The method as in any one of embodiments 1-4, comprising displacing the first tongue (30') from the end position to the front position, preferably between an upper curve shaped surface (104) and lower curve shaped surface (103) of the tongue queue device (100).

6. The method as in embodiment 5, comprising rotating the first tongue (30') during said displacing of the first tongue from the end position to the front position.

7. The method as in embodiment 5 or 6, comprising displacing the first tongue (30") in a first direction and in a second direction, which is perpendicular to the first direction, during said displacing of the first tongue from the end position to the front position.

8. A machine for inserting tongue in an inserting groove (20) in a panel, the machine comprising
   - a tongue queue device (100), the tongue queue device comprising an upper surface (104) and an opposite lower surface (105) configured to guide tongues) from an inlet to an outlet of the tongue queue device,
   - characterised in that the machine comprises a separating device (110), preferably at the inlet of the tongue queue device, configured, to compress the tongues (30), that the tongue queue device is configured such that tongues (30) under compression in a tongue queue (52) are displaced between the inlet and the outlet at least partly by compression forces from the tongues (30) under compression, and that the machine comprises, at the outlet of the tongue queue device, an inserting device (100) which is configured to displace a tongue the insertion groove (20).

9. The machine as in embodiment 8, wherein the upper surface (104) and the lower surface (103) are curve shaped.

10. The machine as in embodiment 9, wherein a first tangential direction (106) of the upper surface and/or the lower surface at the inlet is different from a second tangential direction (107) of the upper surface and/or the lower surface at the outlet.

11. The machine as in any one of the embodiments 8-10, wherein the inlet is positioned in a first vertical position and in a first horizontal position and the outlet is positioned in a second vertical position and a second horizontal position, wherein the first vertical position is different from the second vertical position, and wherein the first horizontal position is different from the second horizontal position.

12. The machine as in any one of the embodiments 8-11, wherein the separating device (110) is configured to separate a tongue from a tongue blank (50) by a tool (60) which is rotatable.

13. The machine as in any one of the embodiments 9-12, wherein the upper surface (104) is at an edge of an upper plate shaped element (102) and the lower surface (103) is at an edge of a lower plate shaped element (101).

14. The machine as in any one of the embodiments 9-13, wherein the tongue queue device comprises two or more of said upper plate shaped element (102), preferably arranged at a distance from each other and, preferably parallel to each other, and wherein the tongue queue device comprises two or more of said lower plate shaped element (101), preferably arranged at a distance from each other and preferably parallel to each other.

The invention claimed is:

1. A method for inserting a first tongue of a tongue queue including a plurality of tongues, in an insertion groove in a panel, wherein the method comprises:

displacing a second tongue to an end position of the tongue queue, which comprises the plurality of tongues under compression, in a tongue queue device, compressing the second tongue while in the tongue queue device, displacing the plurality of tongues at least partly by compression forces from the plurality of tongues under compression in a direction of a tongue queue path, displacing the first tongue, which is at a front position of the tongue queue, to an inserting device, displacing the first tongue into an insertion groove in the panel by said inserting device.

2. The method as claimed in claim 1, comprising separating the second tongue from a tongue blank by a separating device.

3. The method as claimed in claim 2, comprising performing said compressing by the separating device.

4. The method as claimed in claim 3, comprising performing said separating and compressing by rotating a tool.

5. The method as claimed in claim 1, comprising displacing the second tongue from the end position to the front position.

6. The method as claimed in claim 5, comprising rotating the second tongue during said displacing of the second tongue from the end position to the front position.

7. The method as claimed in claim 5, comprising displacing the second tongue in a first direction and in a second direction, which is perpendicular to the first direction, during said displacing of the second tongue from the end position to the front position.

* * * * *